US012097942B2

(12) United States Patent
Saruwatari et al.

(10) Patent No.: US 12,097,942 B2
(45) Date of Patent: Sep. 24, 2024

(54) OUTBOARD MOTOR, MARINE VESSEL, AND MARINE PROPULSION DEVICE

(71) Applicant: YAMAHA HATSUDOKI KABUSHIKI KAISHA, Iwata (JP)

(72) Inventors: Kimitaka Saruwatari, Shizuoka (JP); Yuki Ikegaya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 408 days.

(21) Appl. No.: 17/568,885

(22) Filed: Jan. 5, 2022

(65) Prior Publication Data

US 2022/0234706 A1 Jul. 28, 2022

(30) Foreign Application Priority Data

Jan. 22, 2021 (JP) ..... 2021-008737

(51) Int. Cl.

| | |
|---|---|
| ***B63H 20/02*** | (2006.01) |
| ***B63H 20/08*** | (2006.01) |
| ***B63H 20/32*** | (2006.01) |
| ***B63H 23/34*** | (2006.01) |

(52) U.S. Cl.

CPC ..... *B63H 20/02* (2013.01); *B63H 20/08* (2013.01); *B63H 20/32* (2013.01); *B63H 23/34* (2013.01)

(58) Field of Classification Search

CPC ..... B63H 20/02; B63H 20/08; B63H 20/32; B63H 23/34

See application file for complete search history.

(56) References Cited

U.S. PATENT DOCUMENTS

| | | | | |
|---|---|---|---|---|
| 6,814,635 | B1 | 11/2004 | Okabe | |
| 2011/0195620 | A1* | 8/2011 | Davis | B63H 20/14 440/75 |
| 2013/0273792 | A1 | 10/2013 | Davis et al. | |
| 2016/0001867 | A1* | 1/2016 | Saruwatari | B63H 20/32 440/76 |
| 2020/0062362 | A1* | 2/2020 | Nakamura | B63H 23/30 |
| 2020/0130801 | A1 | 4/2020 | Ikegaya et al. | |

FOREIGN PATENT DOCUMENTS

| | | |
|---|---|---|
| EP | 3 613 663 A1 | 2/2020 |
| JP | 2020-029186 A | 2/2020 |

OTHER PUBLICATIONS

Gearcase Application, Preferredmarine.com/gearcase-application/, Oct. 2020. (Year: 2020).*

Official Communication issued in corresponding European Patent Application No. 21218135.8, mailed on Jun. 20, 2022.

Official Communication issued in corresponding European Patent Application No. 21218135.8, mailed on Apr. 15, 2024.

Mercury Marine, "Understanding Mercury Verado Gearcases", https://www.youtube.com/watch?v=k5OgMpgJWkw&t=2s, XP 93147933, Sep. 20, 2013, 1 page.

"Gearcase Application—Mercury Verado gearcase selection", https://preferredmarine.com/gearcase-application, XP093148162, Aug. 7, 2020, 3 pages.

* cited by examiner

*Primary Examiner* — Stephen P Avila

(74) *Attorney, Agent, or Firm* — Keating & Bennett, LLP

(57) ABSTRACT

An outboard motor for attachment to a hull of a marine vessel includes a lower case including a propeller shaft to rotate a propeller, and an upper case including a drive shaft to transmit a power to the propeller shaft. The lower case is selected from among different types of lower cases to be attached to the upper case, and the upper case and the lower case are connected by an intermediate structure.

12 Claims, 8 Drawing Sheets

OUTBOARD MOTOR, MARINE VESSEL, AND MARINE PROPULSION DEVICE

CROSS REFERENCE TO RELATED APPLICATIONS

This application claims the benefit of Japanese Patent Application No. 2021-008737, filed Jan. 22, 2021, which is hereby incorporated by reference herein in its entirety.

BACKGROUND OF THE INVENTION

1. Field of the Invention

The present invention relates to an outboard motor, a marine vessel including a lower case and an upper case, and a marine propulsion device.

2. Description of the Related Art

In the related art, as shown in FIGS. 8A to 8C, an outboard motor 80 includes a lower case 82 having a propeller 81 as a propulsor, and an upper case 83 having a drive shaft that transmits a driving force of an engine as a drive source to the propeller (see, for example, Japanese Laid-open Patent Publication (Kokai) No. 2020-29186). The lower case 82 and the upper case 83 are manufactured via die-casting aluminum, the lower case 82 being attached to the upper case 83 so that a mating surface 82*a* of the lower case 82 is connected to a mating surface 83*a* of the upper case 83.

Since the lower case 82 sinks under a water surface when a marine vessel sails, the lower case 82 significantly affects the sailing performance of the marine vessel. In recent years, the use of the marine vessel has been diversified, and the sailing performance required for the marine vessel has also been diversified, and various types of lower cases corresponding to the sailing performance are manufactured. The lower case is changed (modified) in design in accordance with the required sailing performance, and the changed lower case is attached to the upper case 83.

When the lower case is changed, the shapes of the lower case before and after the change may be different. For example, in the case of a lower case having high-durability, the high-durability lower case 84 is increased in size in order to accommodate drive components having a lifespan twice or more than that of a typical lower case 82 based on the assumption that it will be used for a longer period of time than the typical lower case 82 (FIG. 8B). In the case of a high-speed lower case, a high-speed lower case 85 is designed by being miniaturized so as to be smaller than the typical lower case 82 in order to reduce resistance (FIG. 8C). That is, the high-durability lower case 84 and the high-speed lower case 85 are each different in shape from the typical lower case 82.

Accordingly, as shown in FIGS. 8B and 8C, the mating surface 83*a* of the upper case 83 does not match a mating surface 84*a* of the lower case 84 or a mating surface 85*a* of the lower case 85, and which may be difficult to attach the high-durability lower case 84 or the high-speed lower case 85 to the upper case 83.

In this case, it is necessary to separately manufacture a new and different upper case having a mating surface matching the mating surface 84*a* of the high-durability lower case 84 or the mating surface 85*a* of the high-speed lower case 85. Therefore, there is room for improvement from the viewpoint of reducing the number of components and shortening a development period of the outboard motor.

SUMMARY OF THE INVENTION

Preferred embodiments of the present invention significantly reduce or prevent an increase in the number of types of upper cases.

According to a preferred embodiment of the present invention, an outboard motor for attachment to a hull of a marine vessel includes a lower case including a propeller shaft to rotate a propeller, an upper case including a drive shaft to transmit a power to the propeller shaft, and an intermediate structure connecting the lower case and the upper case, wherein the lower case is selected from among a plurality of different lower cases, and the intermediate structure is configured to connect any of the plurality different lower cases to the upper case.

According to this structural configuration, the intermediate structure connects the upper case and the lower case so as to make it possible to attach, by using the intermediate structure connectable to mating surfaces of many different lower cases with different shapes or sizes, any of the different lower cases to the same upper case, thus eliminating the need to manufacture and provide different upper cases. As a result, it is possible to significantly reduce or prevent the increase in the number of types of upper cases.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1:
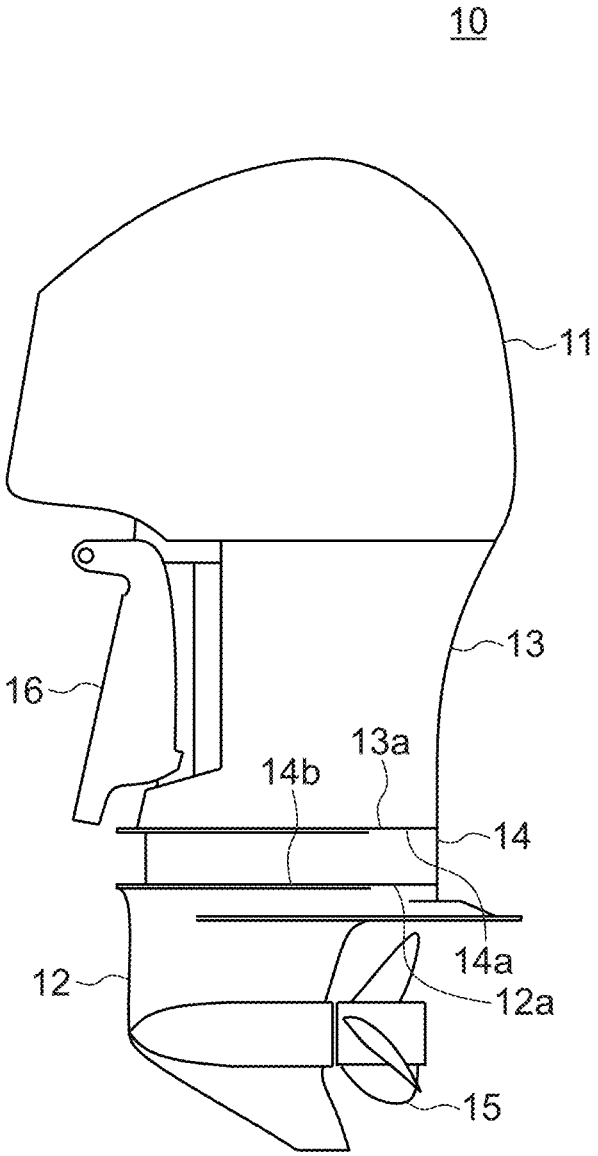
FIG. 1 is an external view schematically illustrating an outboard motor according to a preferred embodiment of the present invention.

FIG. 1 is an external view schematically illustrating an outboard motor according to a preferred embodiment of the present invention. Referring to FIG. 1, an outboard motor 10 includes, as a casing enclosing various components, a cowl 11, a standard lower case 12, an upper case 13, and an attachment 14 (intermediate structure). The cowl 11 encloses an engine (not illustrated) as a drive source, and the standard lower case 12 includes a propeller 15 as a propulsor and encloses a propeller shaft 40 (propeller shaft) to rotate the propeller 15. The upper case 13 encloses a drive shaft 27 to transmit a driving force (power) of the engine to the propeller shaft 40.

In addition, the outboard motor 10 includes a suspension mechanism 16 to attach the outboard motor 10 to a stern (not illustrated) of a hull of the marine vessel, and the suspension mechanism 16 also defines and functions as a steering mechanism and a lifting mechanism of the outboard motor 10 to tilt up the outboard motor 10 when the marine vessel is stored.

The attachment 14 is interposed between the standard lower case 12 and the upper case 13 to connect the standard lower case 12 and the upper case 13. A shape of an upper mating surface 14*a* of the attachment 14 matches a mating surface 13*a* of the upper case 13, and a shape of a lower mating surface 14*b* of the attachment 14 matches a mating surface 12*a* of the standard lower case 12.

Figure 2B:
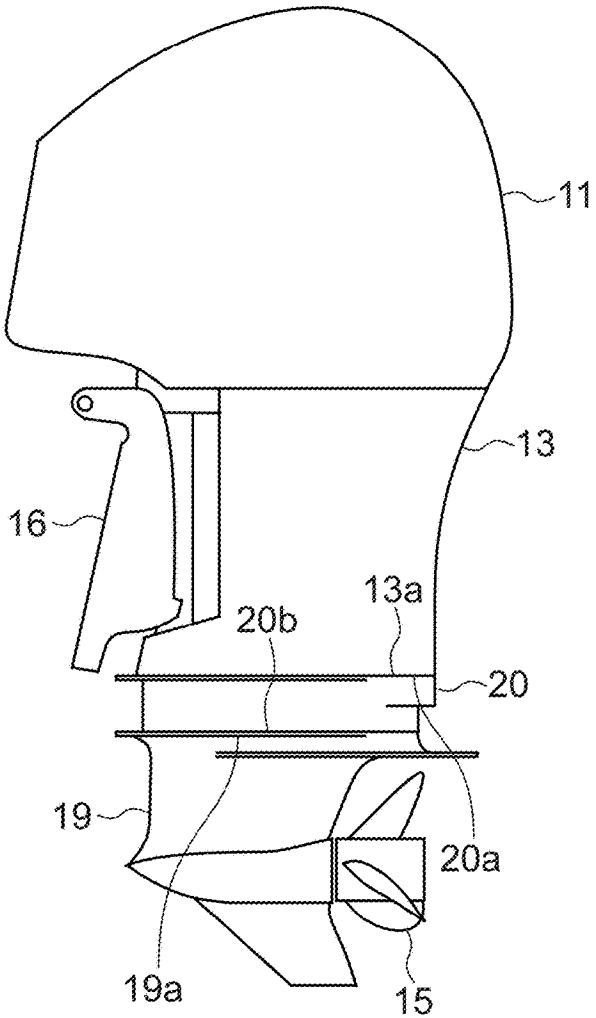
FIGS. 2A and 2B are diagrams for describing attachments corresponding to various lower cases.
Figure 2A:
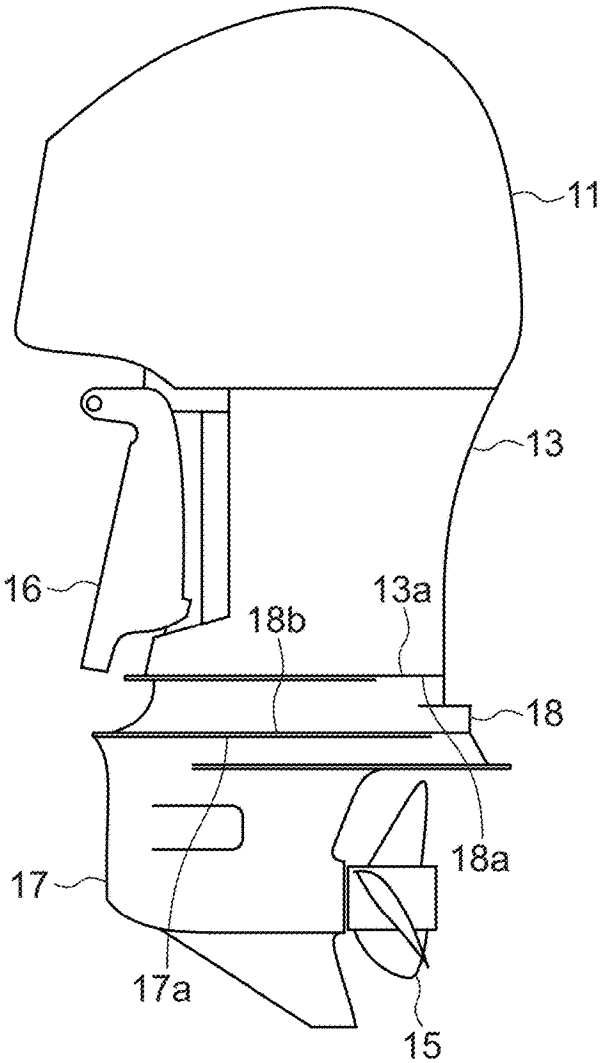

In the outboard motor 10, as illustrated in FIGS. 2A and 2B, in some cases a high-durability lower case 17 or a high-speed lower case 19 is attached instead of the standard lower case 12. However, since the high-durability lower case 17 and the high-speed lower case 19 are different in shape from the standard lower case 12, neither a mating surface 17*a* of the high-durability lower case 17 nor a mating surface 19*a* of the high-speed lower case 19 matches the lower mating surface 14*b* of the attachment 14.

On the other hand, in the present preferred embodiment, an attachment 18 (FIG. 2A) having a lower mating surface 18*b* matching the mating surface 17*a* of the high-durability lower case 17 is used. An upper mating surface 18*a* of the attachment 18 has the same shape as the upper mating surface 14*a* of the attachment 14. Accordingly, the attachment 18 is able to attach to the high-durability lower case 17 and to the upper case 13, and thus is able to connect the upper case 13 and the high-durability lower case 17.

In the present preferred embodiment, an attachment 20 (FIG. 2B) having a lower mating surface 20*b* matching the mating surface 19*a* of the high-speed lower case 19 is used. An upper mating surface 20*a* of the attachment 20 has the same shape as the upper mating surface 14*a* of the attachment 14. Accordingly, the attachment 20 is able to attach to the high-speed lower case 19 and to the upper case 13, and thus is able to connect the upper case 13 and the high-speed lower case 19.

Figure 3B:
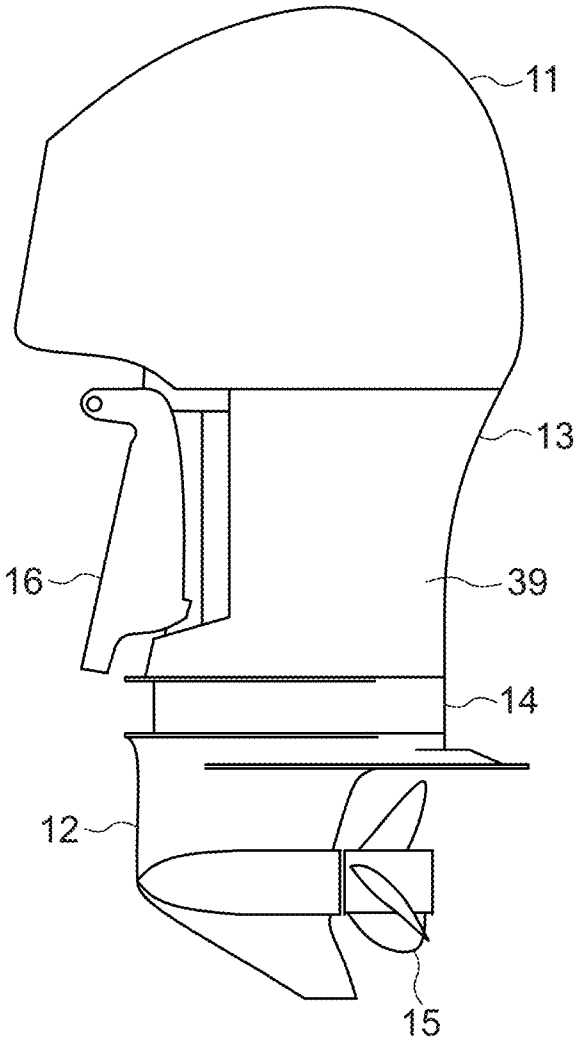
FIGS. 3A and 3B are diagrams for describing a mechanism to transmit a propulsive force of a propeller to a hull of a marine vessel.
Figure 3A:
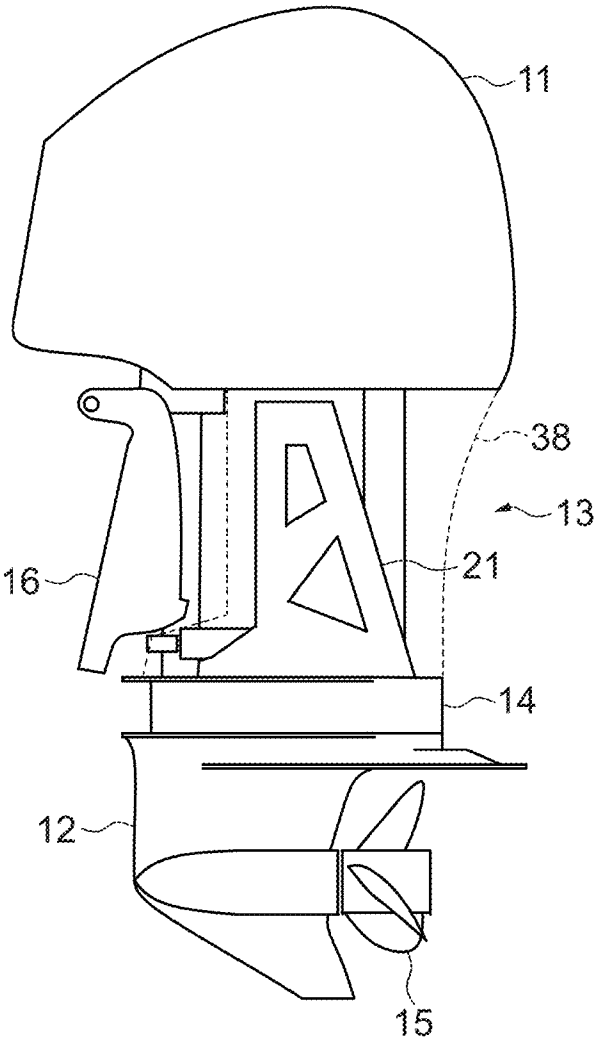

Further, for example, as illustrated in FIG. 3A, the upper case 13 includes a frame body 21 and a resin cover 38 that covers the frame body 21. The frame body 21 is made of metal, for example, aluminum, and is fastened to the attachment 14 and the suspension mechanism 16. A propulsive force generated by the propeller 15 is transmitted to the hull via the standard lower case 12, the attachment 14, the frame body 21, and the suspension mechanism 16. Instead of the frame body 21 and the cover 38, for example and as illustrated in FIG. 3B, the upper case 13 may include a main body 39 in the shape of a case and having a rigid body made of metal, for example, aluminum, and a cover (not illustrated) that improves an appearance of the main body 39, and the main body 39 may be fastened to the attachment 14 and the suspension mechanism 16. In this case, instead of the frame body 21, the main body 39 transmits the propulsive force generated by the propeller 15 to the hull.

According to the present preferred embodiment, since the attachment 14 connects the upper case 13 and the standard lower case 12, when the high-durability lower case 17 or the high-speed lower case 19 are attached to the upper case 13, provided that the attachment 18 connectable to the mating surface 17*a* of the high-durability lower case 17 or the attachment 20 connectable to the mating surface 19*a* of the high-speed lower case 19 is used instead of the attachment 14, the high-durability lower case 17 or the high-speed lower case 19 is able to be attached to the upper case 13. Accordingly, it is possible to eliminate the need to separately manufacture a different, additional upper case 13 when the high-durability lower case 17 or the high-speed lower case 19 is desired, and it is possible to significantly reduce or prevent an increase in the number of types of the upper case 13.

In addition, in the present preferred embodiment, since the outboard motor 10 has the frame body 21 or the main body 39 made of a rigid body, which is fastened to the attachment 14 and the suspension mechanism 16, the propulsive force generated by the propeller 15 is reliably transmitted to the hull via the attachment 14 and the suspension mechanism 16.

Typically, the lower case encloses a gearbox that engages with the drive shaft to transmit the rotation of the drive shaft to the propeller shaft, and a link mechanism that switches rotation directions of the propeller. A shift rod is connected to the link mechanism, and the shift rod is parallel or substantially parallel to the drive shaft and is rotated or moved up and down by a shift actuator. The link mechanism moves a dog clutch in the gearbox via a shift slider in accordance with the movement of the shift rod, and thus the link mechanism switches the rotation directions of the propeller. The link mechanism, the shift rod, and the shift actuator define a shift mechanism.

In the related art, although a shift actuator is enclosed in an upper case or a cowl, a distance between a link mechanism and a gearbox may vary in accordance with the type of a lower case, and thus, a relative position (pitch) of a shift rod with respect to a drive shaft may change. As a result, when the lower case is changed and attached, it may be necessary to separately manufacture a different and additional upper case in order to change the pitch between the shift rod and the drive shaft by changing the position of the shift actuator.

Figure 4B:
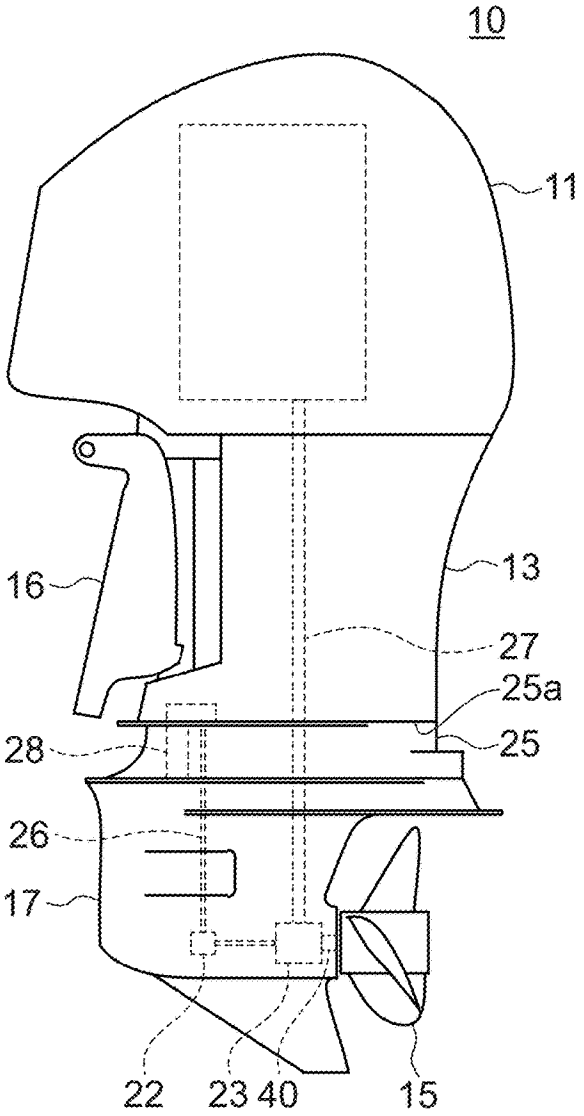
FIGS. 4A and 4B are external views schematically illustrating an outboard motor according to a first variation of a preferred embodiment of the present invention.
Figure 4A:
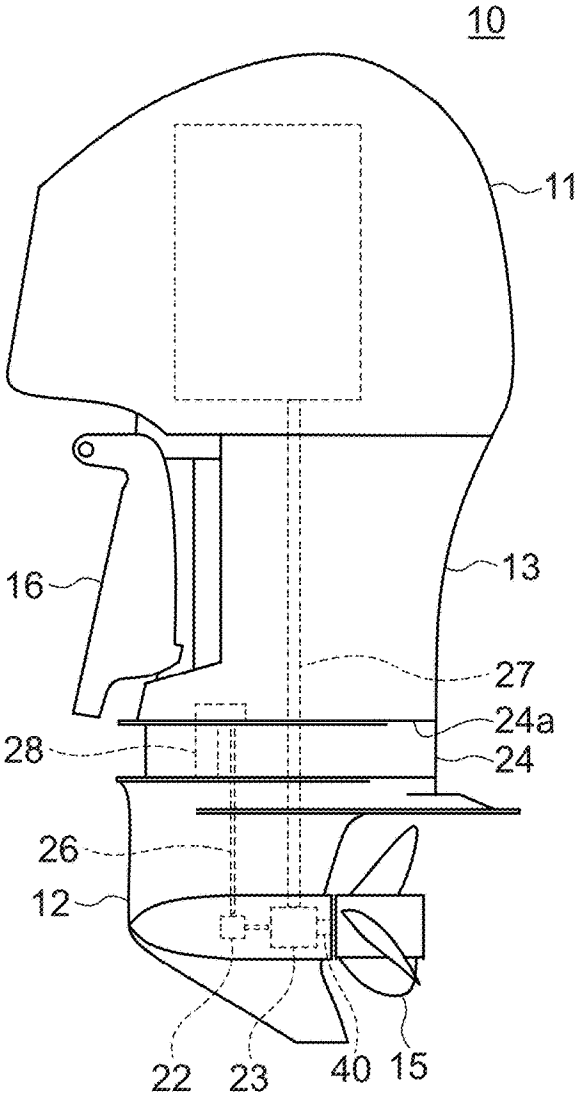

On the other hand, in a first variation of a preferred embodiment of the present invention, the shift actuator is located in the attachment. FIGS. 4A and 4B are external views schematically illustrating an outboard motor according to the first variation. For example, there are some cases in which a distance between the enclosed link mechanism 22 and gearbox 23 is different between the standard lower case 12 and the high-durability lower case 17. The present variation presents attachments 24 and 25 respectively corresponding to the standard lower case 12 and the high-durability lower case 17. A shape of an upper mating surface 24*a* of the attachment 24 is the same as a shape of an upper mating surface 25*a* of the attachment 25.

In the attachment 24, a position of a shift actuator 28 is set such that a pitch between a shift rod 26 and a drive shaft 27 (drive shaft) corresponds to a distance between the link mechanism 22 and the gearbox 23 in the standard lower case (FIG. 4A). Similarly, in the attachment 25, a position of the shift actuator 28 is set such that a pitch between the shift rod 26 and the drive shaft 27 corresponds to a distance between the link mechanism 22 and the gearbox 23 in the high-durability lower case 17 (FIG. 4B). It should be noted that when the distance between the link mechanism 22 and the gearbox 23 enclosed in the high-speed lower case 19 is different from the distance between the link mechanism 22 and the gearbox 23 enclosed in the standard lower case 12 or the high-durability lower case 17, an attachment in which the position of the shift actuator 28 is set such that the pitch between the shift rod 26 and the drive shaft 27 corresponds to the distance between the link mechanism 22 and the gearbox 23 in the high-speed lower case 19 is used.

Accordingly, even though the distance between the link mechanism and the gearbox is different among different the different types of lower cases, the differently shaped or sized lower case is able to be attached to the same upper case by replacing the attachment. That is, it is possible to eliminate the need to manufacture and provide different upper cases 13, and to significantly reduce or prevent an increase in the number of types of the upper case 13.

It should be noted that, although a plurality of types of attachments in which the position of the shift actuator 28 is changed in accordance with the type of the lower case is used in the present variation, in a case in which the shape of the mating surfaces of the various lower cases is not changed, the shift actuator 28 may be movable in the attachment so that the position of the shift actuator 28 is changed in accordance with the distance between the link mechanism 22 and the gearbox 23 in each lower case. In this case, it is possible to eliminate the need to manufacture and provide differently shaped or sized attachments, which significantly reduces or prevents an increase in the number of types of attachments.

In addition, in recent years it has been studied in outboard motors to drive the propeller not only by an internal combustion engine but also by an electric motor. For example, a hybrid outboard motor including an engine and an electric motor is disclosed in Japanese Laid-open Patent Publication (Kokai) No. 2020-29186.

The lower case in the hybrid outboard motor encloses a motor gearbox to transmit a driving force of the electric motor to the propeller shaft in addition to the link mechanism and the gearbox which engages with the drive shaft to transmit the driving force of the engine. The electric motor is located in the lower case in the hybrid outboard motor described in Japanese Laid-open Patent Publication (Kokai) No. 2020-29186. However, since the shape of the lower case greatly affects the sailing performance of the marine vessel, an electric motor that affects the shape of the lower case is preferably located in the upper case. Therefore, when the outboard motor is a hybrid, it may be necessary to manufacture not only the lower case but also the upper case and locate the electric motor in the upper case.

Figure 5B:
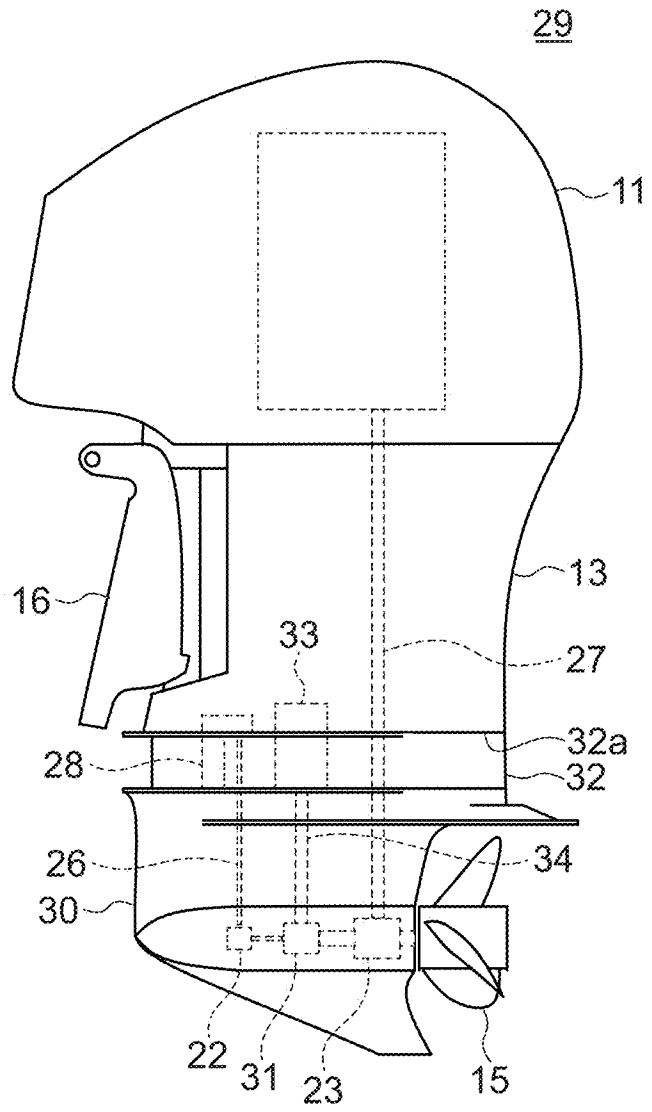
FIGS. 5A and 5B are external views schematically illustrating an outboard motor according to a second variation of a preferred embodiment of the present invention.
Figure 5A:
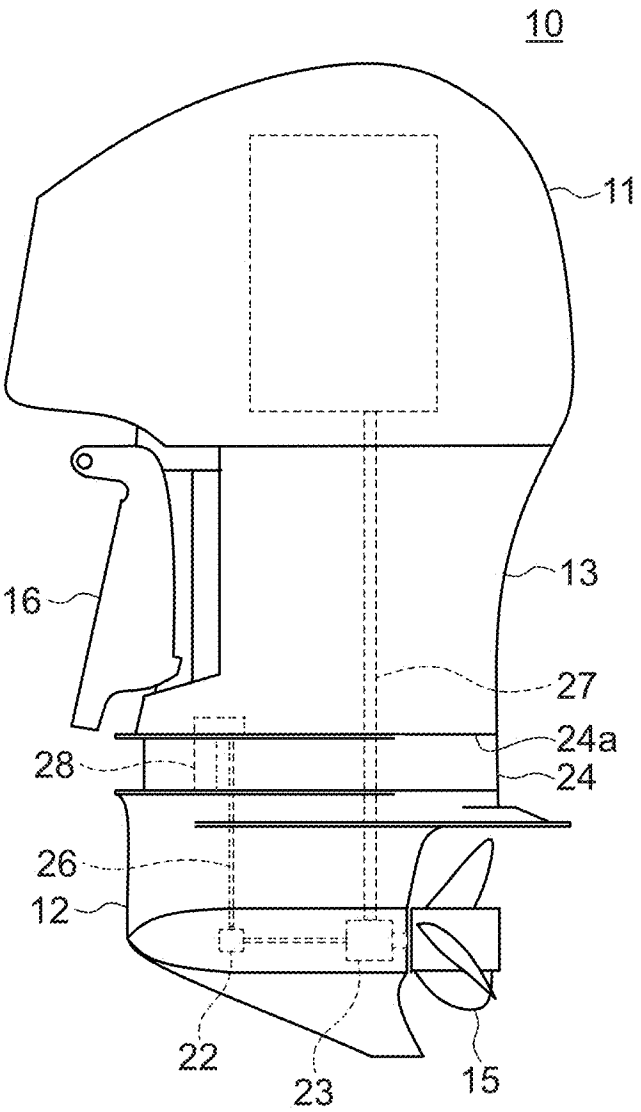

Regarding this matter, in a second variation of a preferred embodiment of the present invention, the electric motor is located in the attachment. FIGS. 5A and 5B are external views schematically illustrating an outboard motor according to the second variation of a preferred embodiment of the present invention.

In the outboard motor 10 which is not a hybrid and in which the propeller 15 is driven only by an engine as described above, the standard lower case 12 encloses the link mechanism 22 and the gearbox 23 but does not enclose a gearbox for a motor (FIG. 5A). On the other hand, in a hybrid outboard motor 29, a hybrid-compatible lower case 30 encloses not only a link mechanism 22 and a gearbox 23 but also a gearbox for a motor (a motor gearbox 31) (FIG. 5B). In this case, a hybrid-compatible attachment 32 encloses an electric motor 33, and the electric motor 33 is connected to the motor gearbox 31 via a motor drive shaft 34. With this configuration, in the hybrid outboard motor 29 including the hybrid-compatible attachment 32, a propeller 15 is driven by an engine or the electric motor 33. A shape of an upper mating surface 32*a* of the hybrid-compatible attachment 32 is the same as a shape of an upper mating surface 24*a* of the attachment 24. In the hybrid-compatible attachment 32, the electric motor 33 is located so as to face the motor gearbox 31.

Accordingly, when the standard lower case 12 is replaced with the hybrid-compatible lower case 30 in order to provide a hybrid the outboard motor, the hybrid-compatible lower case 30 is able to be attached to the upper case 13 only by replacing the attachment 24 with the hybrid-compatible attachment 32. Accordingly, it is possible to eliminate the need to separately manufacture a different upper case 13 in order to hybridize the outboard motor, and it is possible to prevent an increase in the number of types of the upper cases 13.

In addition, the electric motor 33 is enclosed in the hybrid-compatible attachment 32, and thus, it is possible to eliminate the need to locate the electric motor 33 in the hybrid-compatible lower case 30, which makes it possible to prevent the shape of the hybrid-compatible lower case 30 from being hydrodynamically disadvantageous. As a result, even though the outboard motor is a hybrid, it is possible to reduce or prevent a significant influence on the sailing performance of the marine vessel.

Instead of the hybrid-compatible lower case 30, a high-durability hybrid-compatible lower case or a high-speed hybrid-compatible lower case may be used. In this case, the relative position of the motor gearbox 31 with respect to the link mechanism 22 and the gearbox 23 may change. Regarding this matter, the electric motor 33 may be movable in the hybrid-compatible attachment 32 so that the position of the electric motor 33 may be changed in accordance with the relative position of the motor gearbox 31 with respect to the link mechanism 22 and the gearbox 23 in each lower case. Alternatively, a plurality of hybrid-compatible attachments in which the electric motor 33 is provided at the position corresponding to the relative position of the motor gearbox 31 with respect to the link mechanism 22 and the gearbox 23 in each lower case may be prepared, and the hybrid-compatible attachment corresponding to each lower case may be used.

In the outboard motor, since at least a portion of the lower case is submerged and causes splashes while the marine vessel sails, a splash plate (anti-splash plate) to prevent the splashes from scattering may be conventionally provided on the upper case.

The scattering of the splashes changes in accordance with the shape of the lower case. Thus, for example, when the standard lower case 12 is replaced with the high-durability lower case 17 or the high-speed lower case 19, it may be necessary to change the shape of the splash plate in accordance with the scattering of the splashes in each case, and it may be conventionally necessary to separately manufacture and provide additional different upper cases.

Figure 6A:
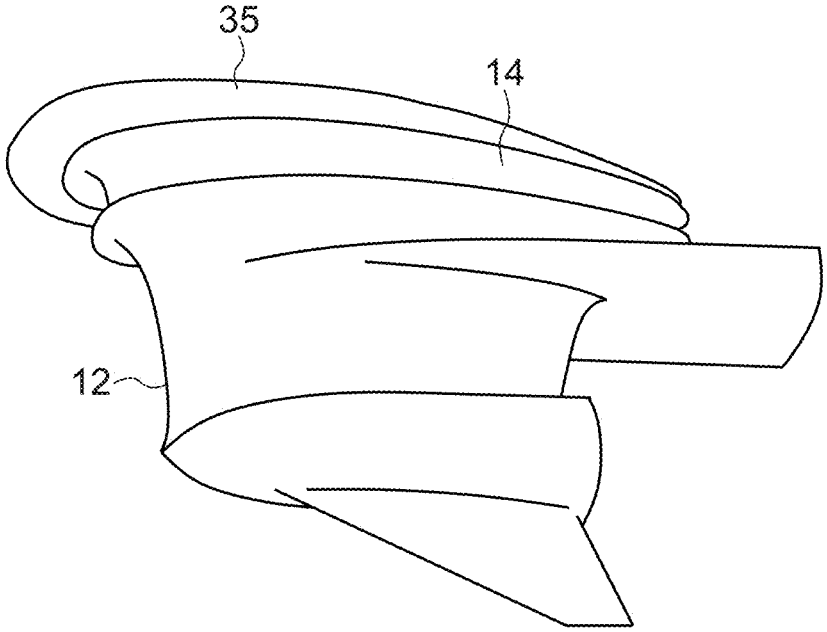
FIGS. 6A and 6B are external perspective views schematically illustrating an attachment of an outboard motor according to a third variation of a preferred embodiment of the present invention.
Figure 6B:
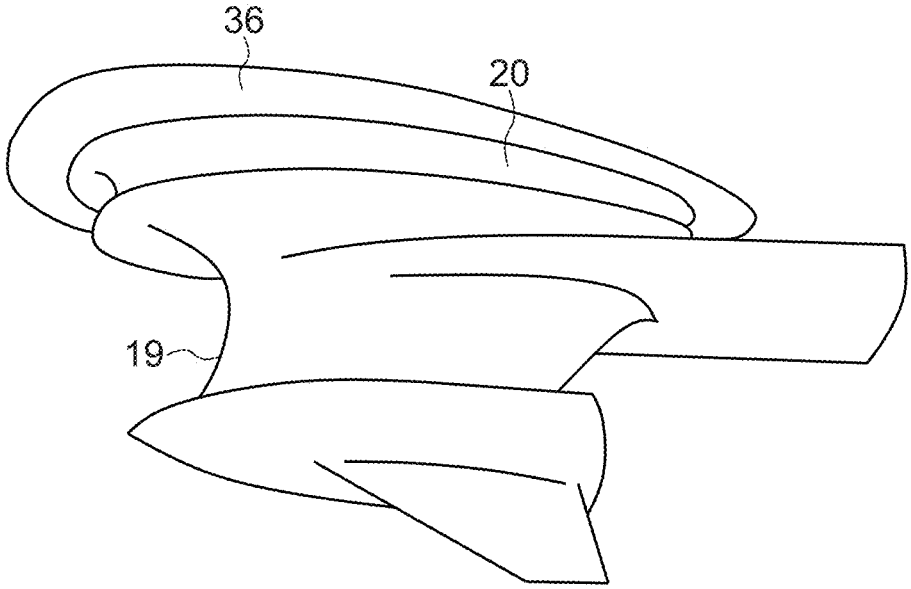

In contrast to the conventional location of the splash plate, in a third variation of a preferred embodiment of the present invention, a splash plate is provided on the attachment. FIGS. 6A and 6B are external perspective views schematically illustrating an attachment of an outboard motor according to the third variation of a preferred embodiment of the present invention.

In the present variation, for example, a splash plate 35 is provided at an upper portion of an attachment 14 attached to a standard lower case 12 (FIG. 6A), and a splash plate 36 is provided at an upper portion of an attachment 20 attached to a high-speed lower case 19 (FIG. 6B). The splash plate 35 and the splash plate 36 have different shapes. Specifically, since the amount of splashes increases when the high-speed lower case 19 is used, the splash plate 36 is larger than the splash plate 35. The splash plate may also be provided at an upper portion of an attachment 18 attached to a high-durability lower case 17, wherein a shape of this splash plate is also different from shapes of the splash plates 35 and 36.

Accordingly, even in a case in which the lower case is replaced and the scattering of the splashes changes, the splash plate suitable for the changed scattering of the splashes is able to be used by replacing the attachment. That is, it is possible to eliminate the need to replace the upper case in order to change the shape of the splash plate, and thus, it is possible to eliminate the need to separately manufacture and provide additional differently shaped or sized upper cases 13.

Each splash plate may be integral with each attachment, or may be separable with respect to each attachment. In a case where each splash plate is separable with respect to each attachment, provided that the shapes of the mating surfaces of the lower cases are the same, the scattering of the splashes is reduced by replacing only the splash plate without changing the attachment in accordance with the change of the lower case. Accordingly, it is possible to save time and effort when replacing the attachment.

Figure 7B:
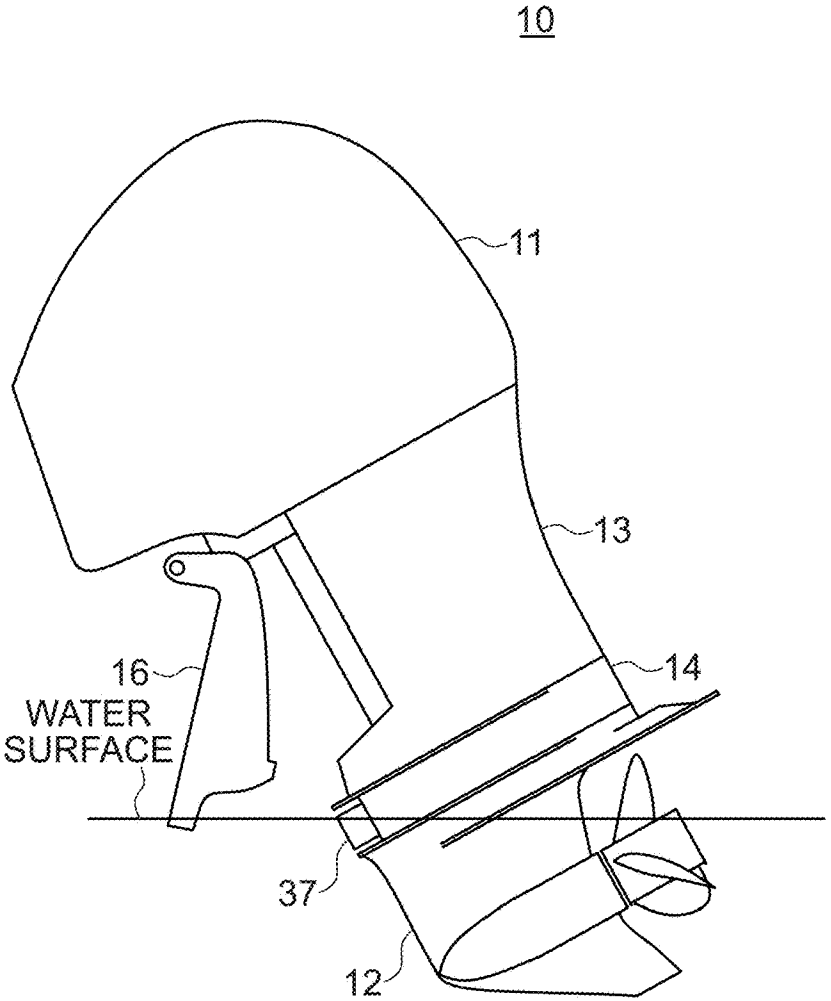
FIGS. 7A and 7B are diagrams for describing sacrificial anodes according to preferred embodiments of the present invention and variations thereof.
Figure 7A:
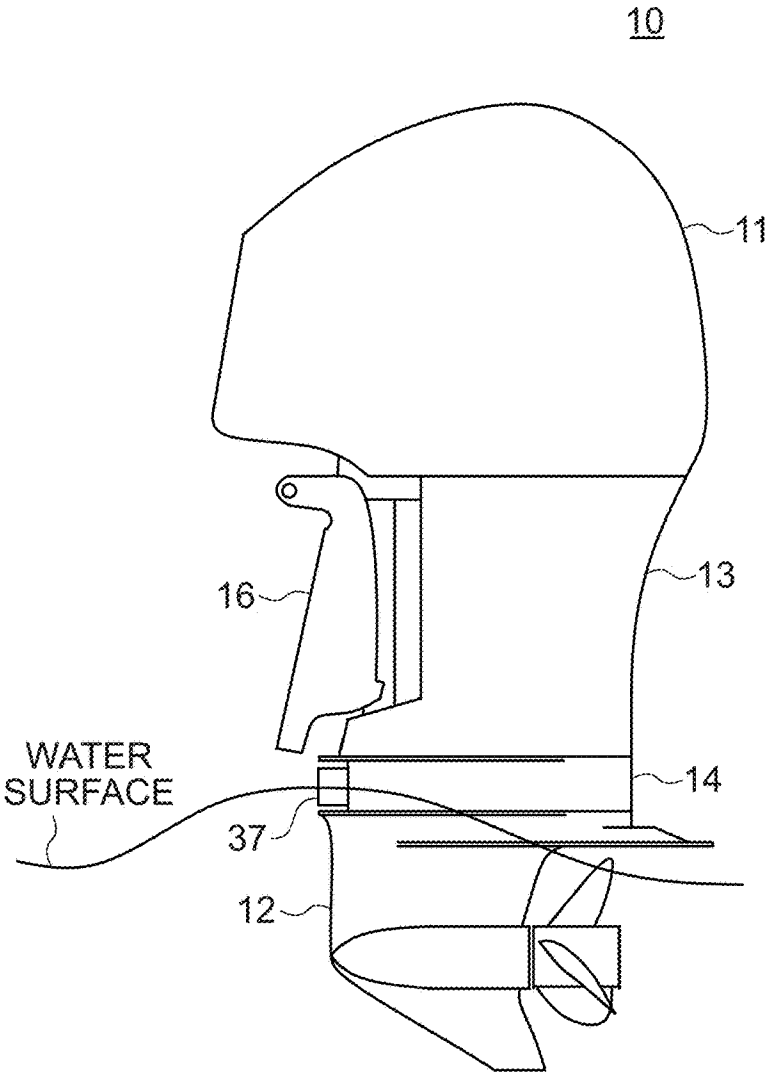
Figure 8C:
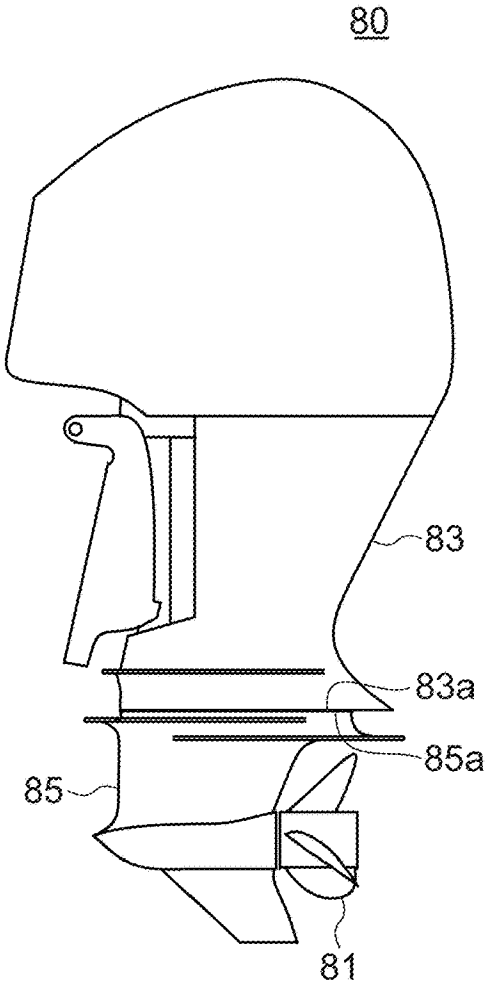
FIG. 8C PRIOR ART
FIGS. 8A to 8C are diagrams for describing a problem associated with a change of a lower case in an outboard motor of the related art.
Figure 8B:
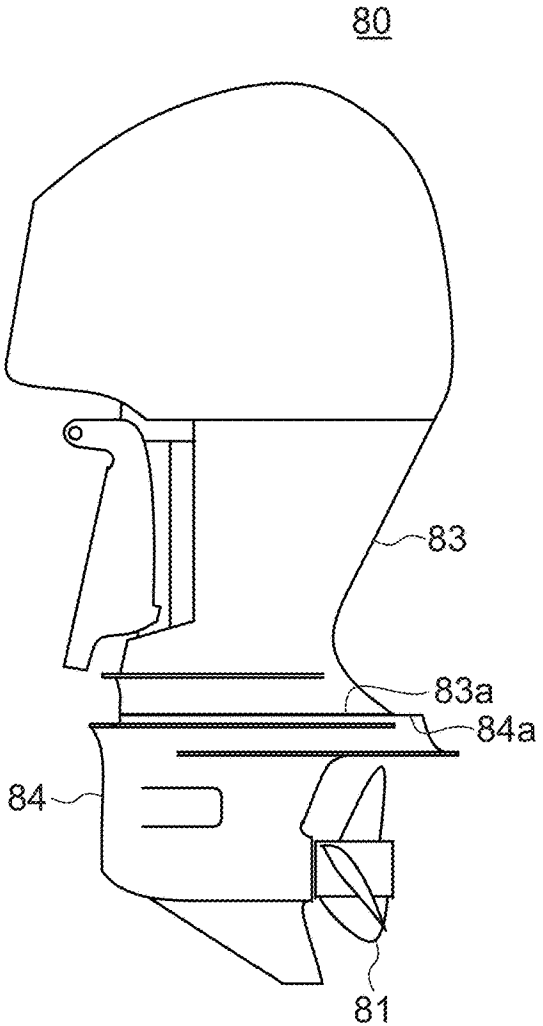
FIG. 8B PRIOR ART
Figure 8A:
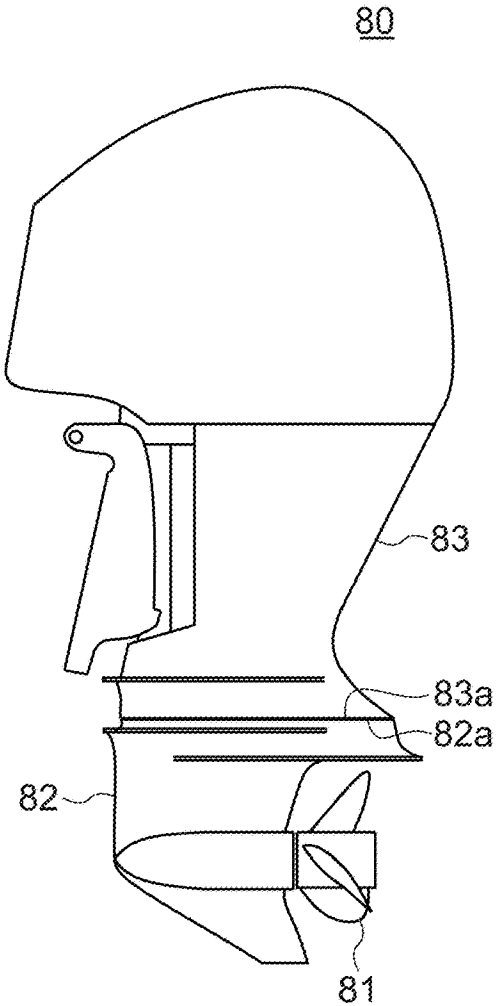
FIG. 8A PRIOR ART

Conventionally, in order to reduce the progress of corrosion of each part of the outboard motor 10, a sacrificial anode is provided in the suspension mechanism and the lower case. Regarding this matter, in the above-described preferred embodiments/variations, a sacrificial anode 37 is provided in the attachment 14. Specifically, in the attachment 14, the sacrificial anode 37 is provided at a position (FIG. 7A) at which waves or splashes are applied while the marine vessel sails, or a position (FIG. 7B) of the marine vessel that is below the water surface even when the outboard motor 10 is tilted up during storage of the marine vessel. With this structural configuration, the sacrificial anode 37 is reliably brought into contact with the water, and thus, the progress of the corrosion of each part of the outboard motor 10 is reduced.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

For example, although preferred embodiments of the present invention are applied to an outboard motor in the above-described preferred embodiments, the present invention may be applied to an inboard/outboard motor including an upper case and a lower case. Likewise in this case, an inboard/outboard motor includes an attachment, and the attachment connects the lower case and the upper case.

What is claimed is:

1. An outboard motor for attachment to a hull of a marine vessel, the outboard motor comprising:

a lower case including a propeller shaft to rotate a propeller;

an upper case including a drive shaft to transmit a power to the propeller shaft; and an intermediate structure connecting the lower case and the upper case; wherein the lower case is selected from among a plurality of different lower cases;

the intermediate structure is selected from among a plurality of different intermediate structures; and a shape of an upper mating surface of the intermediate structure matches a mating surface of the upper case, and a shape of a lower mating surface of the intermediate structure matches a mating surface of the lower case.

2. The outboard motor according to claim 1, wherein the intermediate structure includes a shifter to switch rotation directions of the propeller; and a position of the shifter relative to the drive shaft is changeable.

3. The outboard motor according to claim 2, wherein the shifter includes at least one of a shift rod to switch the rotation directions of the propeller and an actuator to move the shift rod; and a position of the shift rod relative to the drive shaft is changeable.

4. The outboard motor according to claim 1, wherein the intermediate structure includes an electric motor to drive the propeller.

5. The outboard motor according to claim 1, wherein at least a portion of the lower case is submerged below the water and causes splashes while the marine vessel moves;

the intermediate structure includes an anti-splash plate to reduce scattering of the splashes; and a shape of the anti-splash plate is adapted to a shape of the lower case.

6. The outboard motor according to claim 5, wherein the anti-splash plate is separable from the intermediate structure.

7. The outboard motor according to claim 1, wherein at least a portion of the intermediate structure is submerged below the water when the outboard motor is tilted up; and a sacrificial anode is provided at a submerged position of the intermediate structure.

8. The outboard motor according to claim 1, wherein the upper case includes a frame body and a cover that covers the frame body; and the frame body transmits a propulsive force generated by the propeller to the hull of the marine vessel.

9. The outboard motor according to claim 1, wherein the upper case includes a main body; and the main body transmits a propulsive force generated by the propeller to the hull of the marine vessel.

10. A marine vessel comprising:

a hull; and the outboard motor according to claim 1 attached to the hull.

11. A marine propulsion device to be attached to a hull of a marine vessel, the marine propulsion device comprising:

a lower case including a propeller shaft to rotate a propeller;

an upper case including a drive shaft to transmit a power to the propeller shaft; and an intermediate structure connecting the lower case and the upper case; wherein the lower case is selected from among a plurality of different lower cases;

the intermediate structure is selected from among a plurality of different intermediate structures; and a shape of an upper mating surface of the intermediate structure matches a mating surface of the upper case, and a shape of a lower mating surface of the intermediate structure matches a mating surface of the lower case.

12. A method for manufacturing an outboard motor, the method comprising:

providing a plurality of different lower cases each including a propeller shaft to rotate a propeller;

providing an upper case including a drive shaft to transmit a power to the propeller shaft;

providing a plurality of different intermediate structures; and selecting one lower case from among the plurality of different lower cases;

selecting one intermediate structure from among the plurality of different intermediate structures; wherein a shape of an upper mating surface of the one intermediate structure matches a mating surface of the upper case, and a shape of a lower mating surface of the one intermediate structure matches a mating surface of the one lower case.

* * * * *